US007225877B2

(12) United States Patent
Yater

(10) Patent No.: US 7,225,877 B2
(45) Date of Patent: Jun. 5, 2007

(54) SUBSEA INTERVENTION FLUID TRANSFER SYSTEM

(75) Inventor: Ronald William Yater, Houston, TX (US)

(73) Assignee: Varco I/P, Inc., Houston, TX (US)

( * ) Notice: Subject to any disclaimer, the term of this patent is extended or adjusted under 35 U.S.C. 154(b) by 170 days.

(21) Appl. No.: 11/099,207

(22) Filed: Apr. 5, 2005

(65) Prior Publication Data

US 2006/0219412 A1 Oct. 5, 2006

(51) Int. Cl.
*E21B 41/04* (2006.01)

(52) U.S. Cl. ..... 166/344; 166/338; 405/169

(58) Field of Classification Search ..... 166/344, 166/346, 350, 352, 355, 338, 343; 405/155, 405/158, 166, 169
See application file for complete search history.

(56) References Cited

U.S. PATENT DOCUMENTS

| | | | | |
|---|---|---|---|---|
| 3,137,348 | A | 6/1964 | Ahlstone et al. | 166/6 |
| 3,182,877 | A | 5/1965 | Slator et al. | |
| 3,259,198 | A | 7/1966 | Montgomery et al. | 175/7 |
| 3,302,709 | A * | 2/1967 | Postlewaite | 166/340 |
| 3,486,555 | A | 12/1969 | Vincent | 166/0.5 |
| 3,943,868 | A | 3/1976 | Person et al. | 114/0.5 |
| 3,991,837 | A | 11/1976 | Crickmer | 175/27 |
| 4,059,148 | A | 11/1977 | Blomsma | 166/0.5 |
| 4,176,722 | A | 12/1979 | Wetmore et al. | 175/7 |
| 4,335,791 | A | 6/1982 | Evans | 175/228 |
| 4,400,109 | A * | 8/1983 | Gentry et al. | 405/224.3 |
| 4,421,173 | A | 12/1983 | Beakley et al. | 166/336 |
| 4,449,854 | A | 5/1984 | Nayler | 405/195 |
| 4,505,638 | A | 3/1985 | Sugino et al. | 415/113 |
| 4,509,607 | A | 4/1985 | Saxman et al. | 175/227 |
| 4,556,340 | A | 12/1985 | Morton | 405/195 |
| 4,558,890 | A * | 12/1985 | Schartz | 285/13 |
| 4,567,842 | A | 2/1986 | Gibb et al. | 114/230 |
| 4,643,614 | A * | 2/1987 | Laursen | 405/169 |
| 4,650,151 | A | 3/1987 | McIntyre | 251/14 |
| 4,671,702 | A * | 6/1987 | Langner | 405/169 |
| 4,682,913 | A * | 7/1987 | Shatto et al. | 405/169 |
| 4,730,677 | A | 3/1988 | Pearce et al. | 166/345 |
| 4,793,737 | A * | 12/1988 | Shotbolt | 405/169 |
| 4,858,694 | A | 8/1989 | Johnson et al. | 166/355 |
| 4,863,314 | A * | 9/1989 | Baugh | 405/191 |
| 4,878,783 | A * | 11/1989 | Baugh | 405/169 |

(Continued)

OTHER PUBLICATIONS

PCT Int'l Search Report: PCT/GB2005/050193: 3 pp.: mailed Jan. 24, 2006.

(Continued)

*Primary Examiner*—Thomas A. Beach
*Assistant Examiner*—Toni Newville
(74) *Attorney, Agent, or Firm*—Guy McClung

(57) ABSTRACT

A system for subsea transfer of intervention fluids to a subsea intervention apparatus, the system, in certain aspects, including a structure and a frame pivotably mounted thereto, a plurality of frame fluid conduits on the frame for conducting fluid from a connector to conduit apparatus in fluid communication with the subsea intervention apparatus, a connector at an end of the frame for releasably holding an end of a fluid stab assembly, and having a connector fluid conduits in communication with the frame fluid conduits, the connector fluid conduits located for receiving fluid from a fluid stab assembly releasably held by the connector.

26 Claims, 9 Drawing Sheets

U.S. PATENT DOCUMENTS

| | | | | |
|---|---|---|---|---|
| 4,943,187 | A | 7/1990 | Hopper | 405/190 |
| 4,962,817 | A | 10/1990 | Jones et al. | 175/5 |
| 5,042,530 | A | 8/1991 | Good et al. | 137/625.64 |
| 5,190,107 | A | 3/1993 | Langner et al. | 166/355 |
| 5,320,175 | A * | 6/1994 | Ritter et al. | 166/339 |
| 5,884,706 | A | 3/1999 | Edwards | 166/335 |
| 5,895,077 | A * | 4/1999 | Sigmundstad | 285/96 |
| 6,053,252 | A | 4/2000 | Edwards | 166/348 |
| 6,062,769 | A | 5/2000 | Cunningham | 405/195.1 |
| 6,089,321 | A * | 7/2000 | Morrill | 166/341 |
| 6,161,619 | A | 12/2000 | Head | 166/355 |
| 6,182,765 | B1 | 2/2001 | Kilgore | 166/381 |
| 6,223,825 | B1 | 5/2001 | Ingebrigtsen et al. | 166/345 |
| 6,227,300 | B1 | 5/2001 | Cunningham et al. | 166/339 |
| 6,234,717 | B1 * | 5/2001 | Corbetta | 405/170 |
| 6,276,454 | B1 | 8/2001 | Fontana et al. | 166/343 |
| 6,276,456 | B1 | 8/2001 | Head | 166/359 |
| 6,336,238 | B1 | 1/2002 | Tarlton | 15/3.5 |
| 6,343,893 | B1 | 2/2002 | Gleditsch | 405/196 |
| 6,386,290 | B1 | 5/2002 | Headworth | 166/346 |
| 6,408,947 | B1 | 6/2002 | Cunningham et al. | 166/339 |
| 6,460,621 | B2 | 10/2002 | Fenton et al. | 166/347 |
| 6,488,093 | B2 | 12/2002 | Moss | 166/339 |
| 6,585,455 | B1 | 7/2003 | Petersen et al. | 405/224.4 |
| 6,644,410 | B1 * | 11/2003 | Lindsey-Curran et al. | 166/360 |
| 6,659,180 | B2 | 12/2003 | Moss | 166/339 |
| 6,698,520 | B2 | 3/2004 | Fenton et al. | 166/347 |
| 6,763,889 | B2 | 7/2004 | Rytlewski et al. | 166/338 |
| 6,808,021 | B2 | 10/2004 | Zimmerman et al. | 166/381 |
| 2002/0040782 | A1 | 4/2002 | Rytleski et al. | 166/341 |
| 2003/0000740 | A1 | 1/2003 | Haynes et al. | 175/57 |
| 2003/0155127 | A1 | 8/2003 | Carlsen | 166/368 |
| 2003/0178200 | A1 | 9/2003 | Fox et al. | 166/341 |
| 2004/0094305 | A1 | 5/2004 | Skjaerseth et al. | 166/339 |

OTHER PUBLICATIONS

PCT Written Opinion: PCT/GB2005/050193: 5 pp.: mailed Jan. 24, 2006.

* cited by examiner

SUBSEA INTERVENTION FLUID TRANSFER SYSTEM

BACKGROUND OF THE INVENTION

1. Field of the Invention

This present invention is directed to systems and methods for fluid transfer in subsea operations; to heave compensation in subsea operations; to systems and methods for compensating for the movement of sea-going vessels used in wellbore subsea operations; and, in certain particular aspects, to a heave compensation system located subsea.

2. Description of Related Art

In many situations, interventions are required to maintain the performance of an oil or gas well. Interventions typically include but are not limited to: removing debris from a well, shifting production levels in a well, unloading fluid from a well, stimulation of a production zone, and well logging. Often interventions require injection of one or more fluids into a well; e.g. but are not limited to: water, nitrogen, hydrate inhibitors, acids, and cements. Such fluids are transported to the well site, stored in transportable containers, and then pumped into well with specialized pumping equipment.

Well interventions can be performed on subsea wells. However, such interventions can be more complicated due to inaccessibility of the well. A typical subsea well intervention includes utilization of a mobile offshore drilling unit and related specialized equipment. This method of well intervention is costly and time consuming.

Certain prior art methods of performing well subsea interventions use a tool which is deployed from a deployment vessel and attached to the subsea well. The tool, known as a subsea intervention module, includes coiled tubing equipment, intervention tools, well control equipment, control systems, and other equipment required to perform well interventions on subsea wells. The intervention module can be powered and controlled remotely from a deployment vessel via control umbilical.

Intervention fluid and hydrate inhibitor are transferred from the deployment vessel to the tool via an intervention fluid conduit. The intervention fluid conduit is known as the pump down line or "PDL" which consists of a specialized string of steel coiled tubing which is designed to transfer a plurality of discrete fluids simultaneously. The PDL is deployed and connected to intervention module. Surface equipment lowers one end of the PDL to the intervention module on the subsea well after the intervention module has been deployed.

Wave motions at the surface can cause a deployment vessel to heave. Because a PDL is suspended from the deployment vessel, the PDL will heave with the same frequency and as the vessel. The wave-induced PDL motions must be controlled to allow for connection of PDL to an intervention module and to prevent damage to the PDL and any components of the intervention module which could come in contact with the heaving parts.

In the past flexible hoses have been used, but many of the intervention fluids have chemical properties which are incompatible with the lining materials of flexible hoses. High pressure gas intrusion into hose lining can cause separation of the lining from the hose. In addition, pressure differentials between the intervention fluid stream and the sea outside the fluid passages which would cause a collapse of the flexible hose. Also, the constant movement of the flexible hose can cause premature failure of the hoses.

The prior art discloses a wide variety of systems, apparatuses, and methods to compensate for the movement of vessels used in subsea operations. U.S. Pat. Nos. 3,943,868; 3,991,837; 4,858,694; 5,190,107; 4,176,722; 4,059,148; 4,934,870; 4,899,823; 6,343,893; 4,962,817; 6,386,290 and the prior art references cited therein provide a small sampling of the prior art directed to heave compensation and to compensation for the movement of a vessel.

U.S. Pat. Nos. 6,276,454; 6,053,252; 6,698,520; 6,488,093; 6,659,180; 6,460,621; 6,547,008; 6,763,889; and U.S. application Ser. Nos. 10/368,762 filed Feb. 19, 2003 and 10/204,606 filed Feb. 20, 2001, and the prior art cited in these patents and applications, provide a small sampling of prior art references directed to subsea operations and to subsea intervention.

There has long been a need, recognized by the present inventor, for effective and efficient subsea intervention fluid transfer systems and heave compensation systems.

There has long been a need, recognized by the present inventor, for an efficient and effective heave compensation system for use with relatively small and/or monohull vessels.

There has long been a need, recognized by the present inventor, for an efficient and effective heave compensation system for use with a pumpdown line which is deployed from a fixed system on the deck of a vessel.

SUMMARY OF THE PRESENT INVENTION

The present invention, in certain embodiments, discloses apparatus and methods for the simultaneous subsea transfer of multiple streams of intervention fluids to an intervention module; in certain aspects without using flexible hoses.

The present invention, in certain aspects, discloses a system for mechanically linking an intervention fluid conduit to a subsea intervention module. In certain aspects the system includes apparatus to compensate for motions applied to a subsea fluid conduit by wave action which acts on a deployment vessel from which the fluid conduit is suspended. In certain aspects, the invention includes a system for attachment of a heaving conduit to a stationary intervention module in a controlled manner.

In certain aspects, the present invention discloses apparatus for the latching and release of an intervention fluid conduit to a subsea intervention module in normal deployment and in emergency disconnect situations.

The present invention, in at least certain embodiments, discloses a heave compensation system which is pivotably connectable below the water's surface to a subsea structure, e.g., but not limited to, a subsea intervention module. The system has a frame whose first end is pivotably mountable to the subsea structure and on whose second end is releasably connected a receiver for receiving a fluid stab apparatus, e.g. a "hot stab" apparatus. In one aspect fluid communication is provided between the received apparatus (in the receiver) and devices, systems, or apparatuses spaced-apart from the heave compensation system, e.g. with the appropriate flow lines, conduits, pipes and/or hoses.

In certain embodiments, a winch apparatus is used in selective raising and lowering of the heave compensation system's frame. Free pivotal mounting of the frame to a subsea structure provides a range of free movement for the heave compensation system and for the apparatus received in the receiver. By releasably connecting a winch line of the winch system to a pump down line (e.g. using an ROV) which has not yet been connected to a receiver, the winch system can bring the pump down line to the receiver with the movement of the frame corresponding to the movement of the pump down line as the pump down line approaches the receiver. The winch line is in a slack state when the winch line is connected by the ROV to the pump down line. The winch line pulls the fluid stab apparatus horizontally to the receiver as the frame is rotated out from the subsea structure to move the receiver to the fluid stab apparatus. Specialized equipment is used to make attachment and to provide a fluid connection to the subsea intervention module. The intervention fluid stab end of the PDL is weighted to prevent the PDL from deflecting from the intended trajectory due to sea currents during deployment.

In one particular aspect, fluids (e.g. hydrate inhibitor fluid) in one flow path of the fluid stab apparatus and treatment fluids in another flow path flow to the receiver and then from the receiver to another subsea system or apparatus, including, but not limited to, a subsea intervention module or system.

In certain aspects, the present invention discloses a system for mechanically linking an intervention fluid conduit to a subsea intervention module which compensates for motions applied to the conduit by wave action which will act on a deployment vessel from which the fluid conduit is suspended. Additionally, in certain aspects, the present invention discloses a system for attachment of a heaving conduit to a stationary intervention module in a controlled manner. In certain aspects, after the PDL is connected to the intervention module, a compliant connection is employed to prevent damage to the PDL, the intervention module, and the well.

It is, therefore, an object of at least certain preferred embodiments of the present invention to provide new, useful, unique, efficient, nonobvious subsea intervention systems, subsea fluid transfer systems, and subsea intervention heave compensation systems and methods;

Such systems and methods which need not employ flexible hoses or conduits;

Such systems and methods which simultaneously transfer multiple intervention fluids; and Such systems and methods for the effective latching and release of an intervention fluid conduit to a subsea intervention module in normal and in emergency situations.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
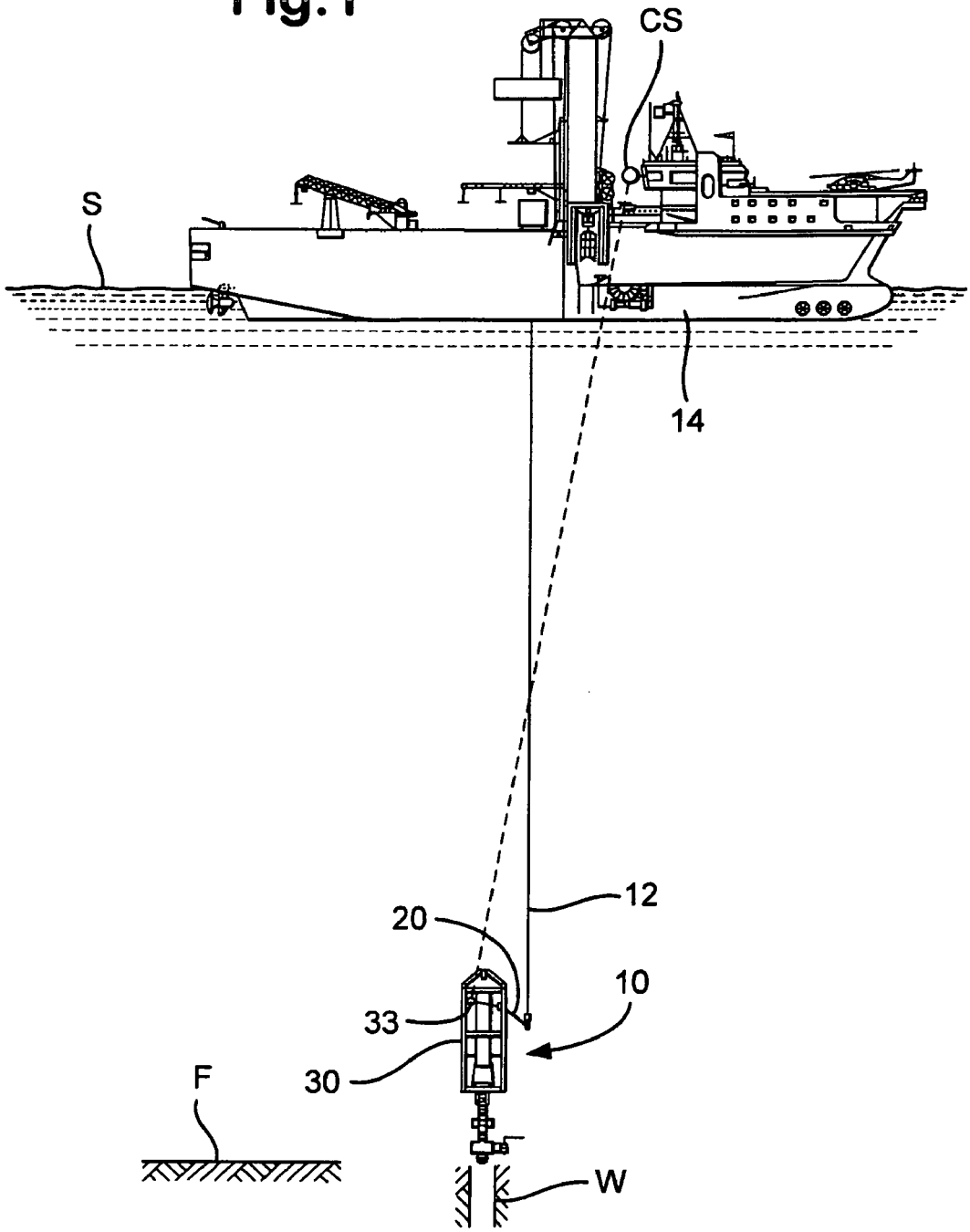
FIG. 1 is a side schematic view of a subsea intervention system according to the present invention with a heave compensation system according to the present invention.
Figure 3:
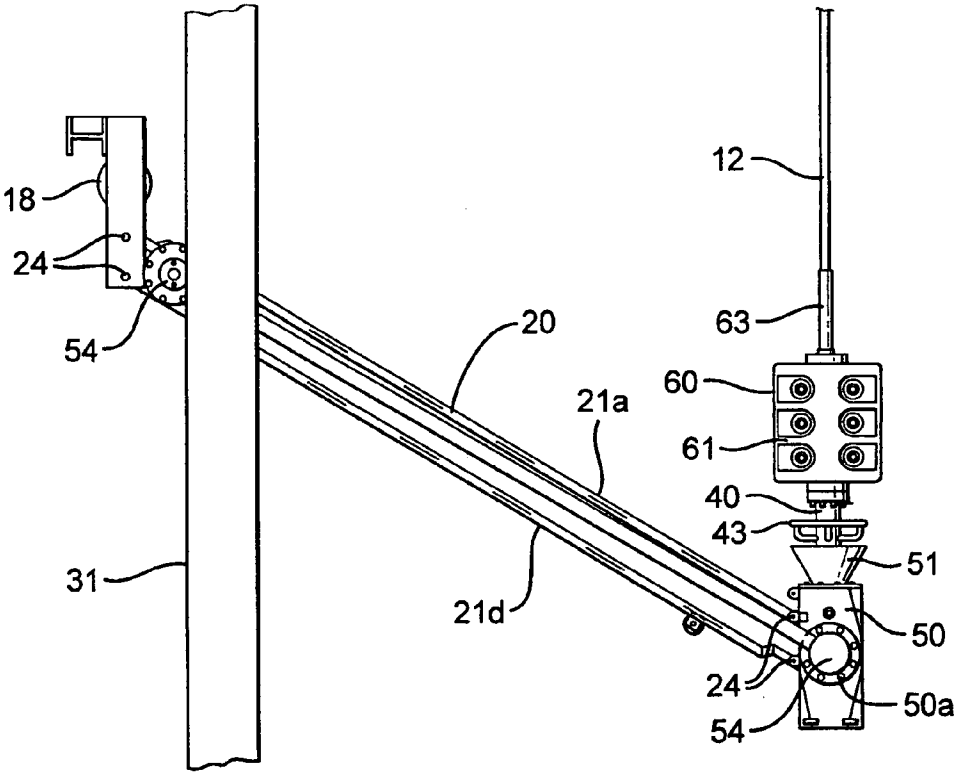
FIG. 3 is an enlarged view of part of the system of FIG. 2.
Figure 2:
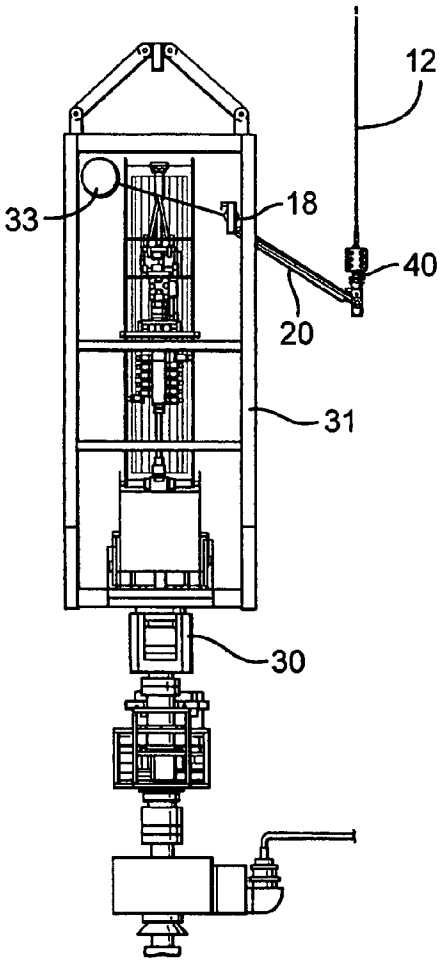
FIG. 2 is an enlarged view of the parts of the system of FIG. 1.
Figure 4:
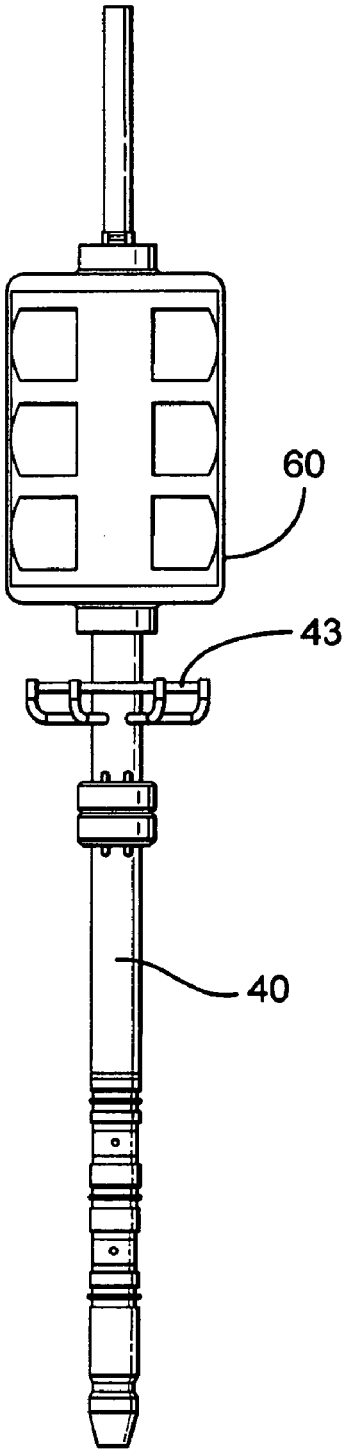
FIG. 4 is a side view of a fluid stab apparatus of the system of FIG. 1.
Figure 5A:
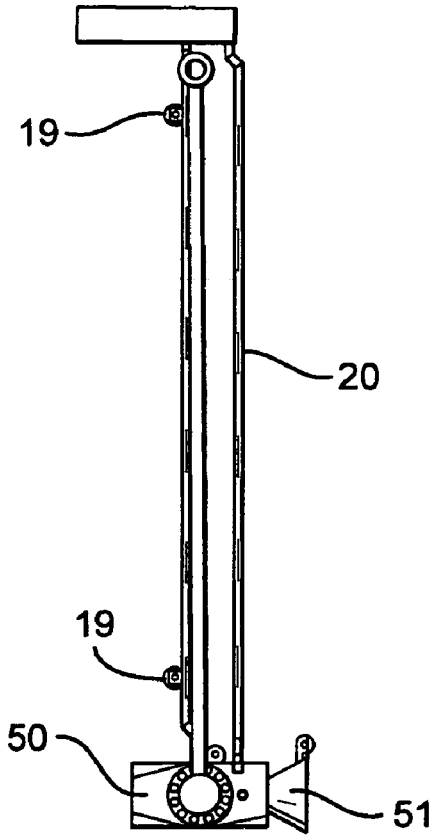
FIGS. 5A and 5B are side views showing steps in a method of use of the fluid stab apparatus of FIG. 4.
Figure 5B:
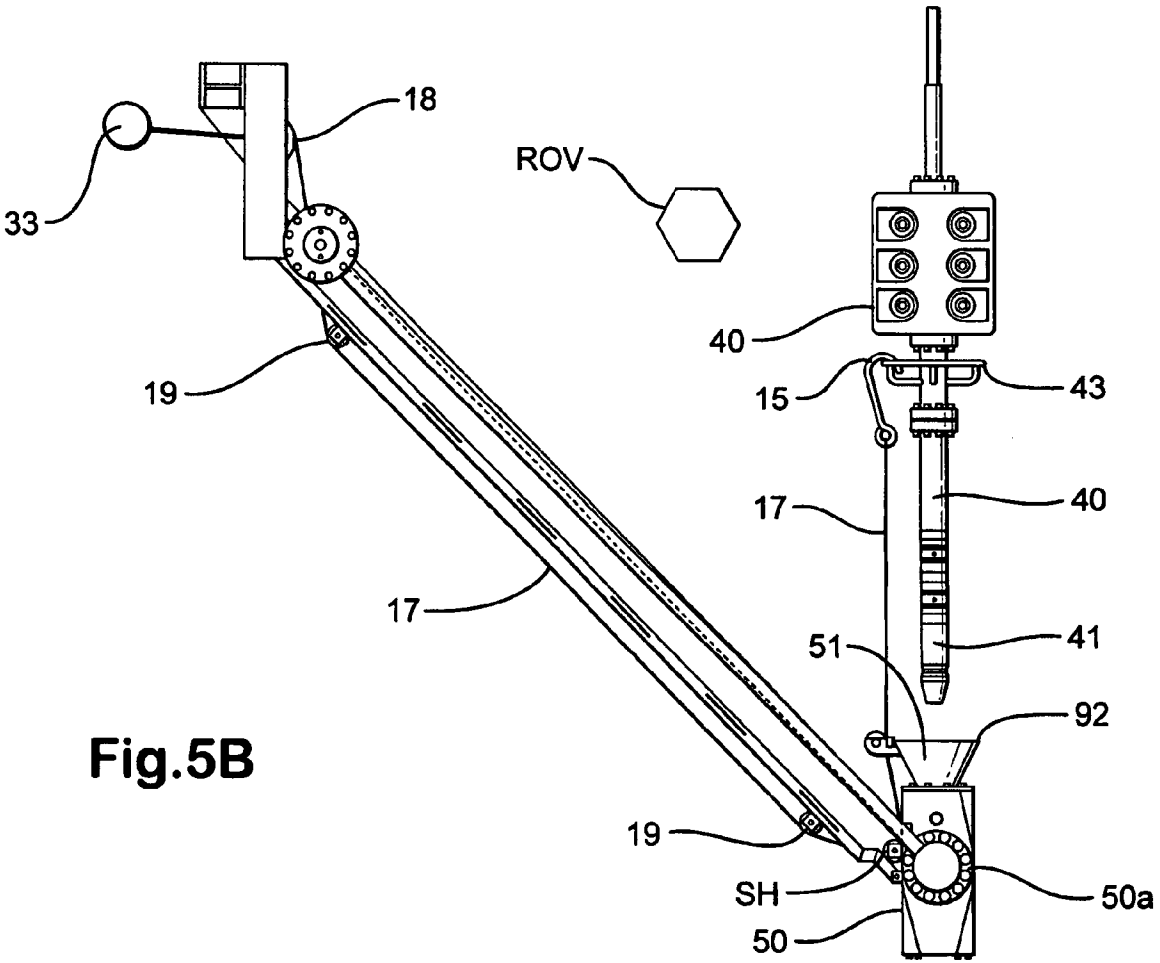

FIG. 1 shows a system 10 according to the present invention for connecting a pump down line 12 between a vessel 14 floating on a water surface S and a subsea intervention module 30 at an ocean floor F and operating the pump down line ("PDL") 12 during subsea intervention. The subsea intervention module 30 is deployed on a subsea well W. A heave compensation device 20 is used to dampen the resulting motion of the PDL 12 when the vessel 14 heaves with the motion of the seas. The device 20 is a compliant device employed to allow connection of an intervention fluid stab assembly 40 with continuous vertical motions to the intervention module 30 using a connector 50.

The device 20 includes a frame which has equal length linkage beams 21*a*, 21*b* and 21*c*, 21*d*. The beams 21*a*-21*d* are attached to a frame 31 of the intervention module 30 by pins 24. The pins 24 are placed to allow rotation of each of the beams 21*a*-21*d* about the pins in a vertical plane.

Ends of the beams 21*a*-21*d* are connected to a funnel part 51 of a PDL connector 50. The location of the pins 24*a*-24*d* allows the assembly of beams 21*a*-21*d* and the connector 52 to move and rotate in a vertical plane while maintaining a fixed vertical orientation of the axis of the connector bore 52. Rotation of the assembly about the axis of the pins 24 on the intervention module 30 gives the connector 50 the ability to conform to the vertical motions of a PDL assembly 60 with the fluid stab assembly 40. This configuration also constrains the PDL assembly 60 in the horizontal plane. In addition, this configuration fixes vertical orientation of the PDL assembly 60.

The PDL 12 supplies intervention fluids to the intervention module 30. This task can be complicated by the requirement to mitigate heave of the vessel 14. The complication results from the need to transfer the fluids from a moving assembly to a fixed assembly. With certain systems according to the present invention fluids are transferred to the intervention module 30 without reliance on any flexible hoses, conduits, or expansion joints since the rigid beams 21*a*-21*d* fix the distance of the connector 50 and PDL assembly 60 to the intervention module 30.

Figure 6:
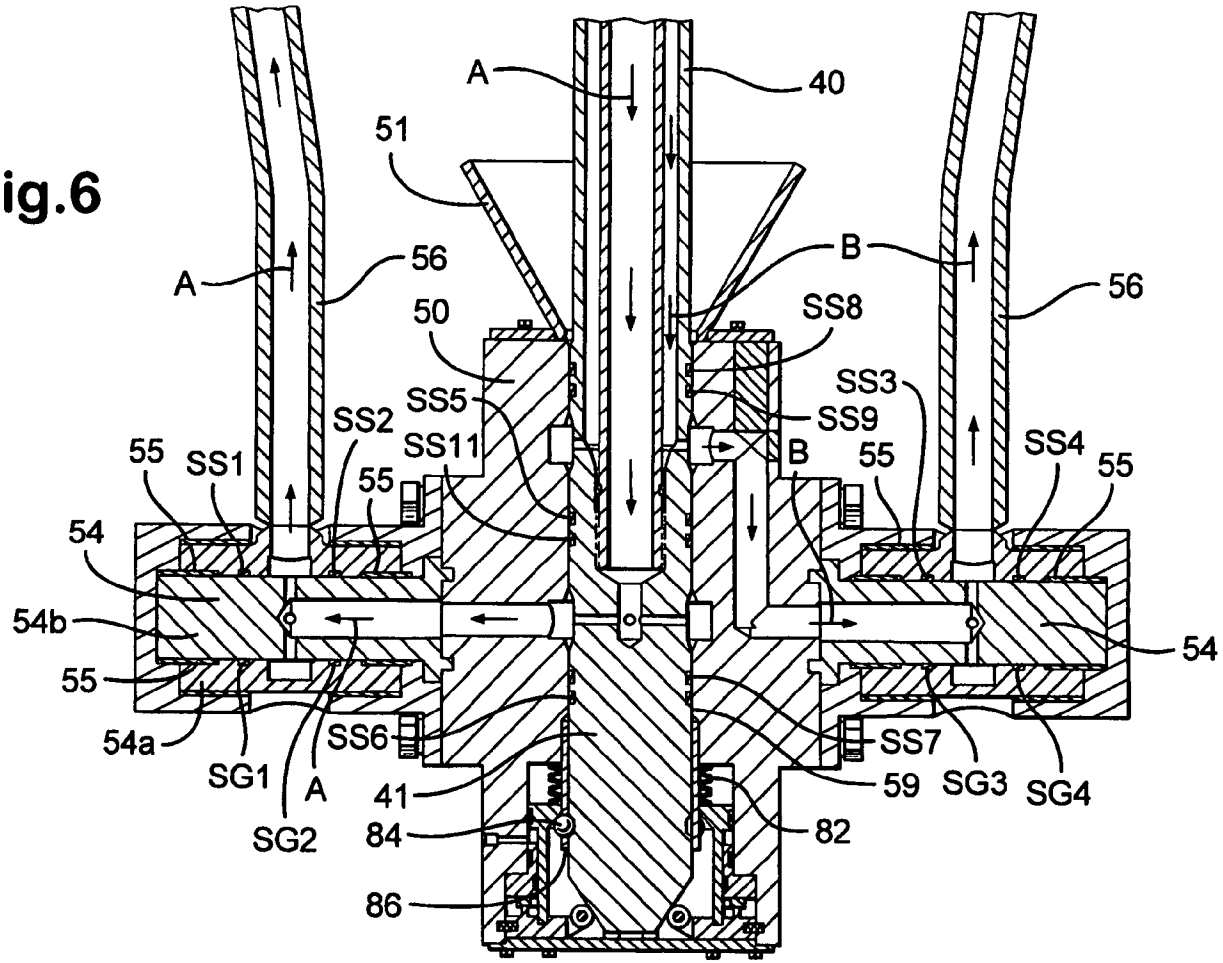
FIG. 6 is a cross-section view of part of the system of FIG. 1 with the fluid stab apparatus latched in a fluid manifold.

Fluid swivels 54 at the ends of the rigid beams transfer fluids in fluid conduits 56 without flexible hoses or flexible connections. A first fluid's transfer is indicated by the arrows A in FIG. 6. Arrows B indicated a second fluid's transfer. Bodies 54*a* of the fluid swivels rotate on center members 54*b* of the fluid swivels. The fluid swivels 54, in one aspect, are configured to resist high pressure differentials from external or internal sources and material selection enables a multitude of volatile fluids to be pumped to the intervention module. The fluid swivels 54 can also withstand high pressure differentials from either external or internal sources without a corresponding increase in force and bending moment loading to bearings 55 of the fluid swivel, allowing the entire assembly to rotate freely with an economy of design.

To aid in deployment, the assembly 60 is, optionally, weighted with weights 61. FIGS. 3-7B show components of the assembly 60 including a stab 41 and an attachment ring 43. The fluid conduits 56, which pass the fluid from the intervention fluid transfer manifold 52 to the intervention module 30, allow the transfer of varied intervention fluids. Optionally a bend restrictor 63 is used on the PDL 12 above the weights 61.

The fluid swivels 54 are, in one aspect, pressure balanced to cause pressure induced loading to be contained within individual components, thus decreasing or removing thrust loads which could cause parts to attempt to separate or bind. The fluid swivels 54 are reduced in size and weight, since the bearings 55 in the fluid swivels experience a minimal thrust loading. Reduction or elimination of thrust loading results in lower bearing friction so that the fluid swivels 54 rotate more freely. The fluid swivels 54 are designed to substantially reduce or eliminate a pressure-induced axial force which would tend to separate the fluid swivel and would result in a high rotational frictional force in the swivel. Spaced-apart seal glands on each side of channels through the conduits 56 contain seals (seal gland SG1 contains seal SS1; seal gland SG2 contains seal SS2; seal gland SG3 contains seal SS3; and seal gland SS4 contains seal SS4). With seals positioned on each side of the fluid glands fluid induced loads are cancelled. The bearings 55 are located outboard of adjacent seals. Since loading is substantially reduced due to the swivel design and the parallel support beams, the bearings 55 can be water lubricated bearings.

The deployment vessel 14 is moved to position the PDL fluid stab assembly 60 a few meters outside of the range of the heave compensation system 20. At that time, the heave compensation system 20 is stowed at the side of the intervention module. The fluid stab assembly 60 and the connector 50 are drawn together by utilizing a winch 18, a winch line 17, a hook 15, and pulley system 19. To initiate the attachment procedure, an ROV carries a slack winch line to the attachment ring 43 on the fluid stab assembly 60. After attaching the hook 15*a* to the attachment ring 43, the ROV withdraws. The winch 18 is mounted on the intervention module frame 30 and is operated via an intervention module control system 33 in communication with a control system CS on the boat 14. Prior to deployment, the winch line 17 is placed such that when the fluid stab assembly 60 is attached to the connector 50 the heaving motion of the fluid stab assembly 60 is matched precisely by the connector 50. When the winch is activated, the connector 50 is pulled from a stowed position at the side of the intervention module 30 by tension applied by the winch line 17. As the winch line 17 is drawn in, the fluid stab assembly 60 and the connector 52 are drawn together by the shortening winch line until a latching sequence is initiated. During this process, the heave of the fluid stab 60 with respect to the connector 50 is negated since the weight of the connector 50 is supported via a sheave SH on the connector 50 by the winch line 17 attached to the ring 43. Since the intervention fluid transfer manifold 52 and intervention fluid stab 40 are connected by a taut winch line 17, the oscillating vertical motions of the fluid stab assembly 60 are followed by the connector 50. This feature prevents damage to the mating parts of the intervention fluid stab assembly 60 due to dynamic loading as they are drawn together. As the intervention fluid stab assembly 60 and connector 50 are drawn together, the funnel part 51 corrects any misalignment. After latching of the stab 41 in the connector 50, the winch line 17 is slacked and the ROV disconnects the winch line 17 from the attachment ring 43. In one method according to the present invention of attachment of the PDL 12 to the intervention module 30, the fluid stab assembly 60 of the PDL 12 is lowered on the PDL 12 to a depth which will put the fluid stab assembly 60 at about the middle of the travel of the PDL heave compensation system 20.

The fluid stab assembly 60 and the connector 50, in certain aspects, accommodate simultaneous transfer of a plurality of intervention fluids, e.g. to provide hydrate inhibitor to the well area of the intervention module 30 during all stages of a well intervention. Additionally, the fluid stab assembly 60 and the connector 50, in certain aspects, transfer fluids at high differential pressures (either internal or external source) with little or no resulting thrust load acting on the latching system. The fluid stab and the fluid transfer manifold are designed to negate pressure induced thrust loading on the mating assemblies. As in one embodiment of the fluid swivels, the fluid transfer glands are fitted with seals on both sides of the gland. This results in an equal area exposed to the pressure on opposite ends of the gland which in turn will result in equal and opposite thrust forces on the assembly so that no unbalanced force is seen by the assembly. This allows for predictable action of an emergency disconnect system and for economy of design. The only force acting on the latching system is the weight of the fluid transfer manifold. Therefore, a small and predictable releasing force can be designed into the latching system as a passive disconnect or an emergency disconnect.

Figure 7A:
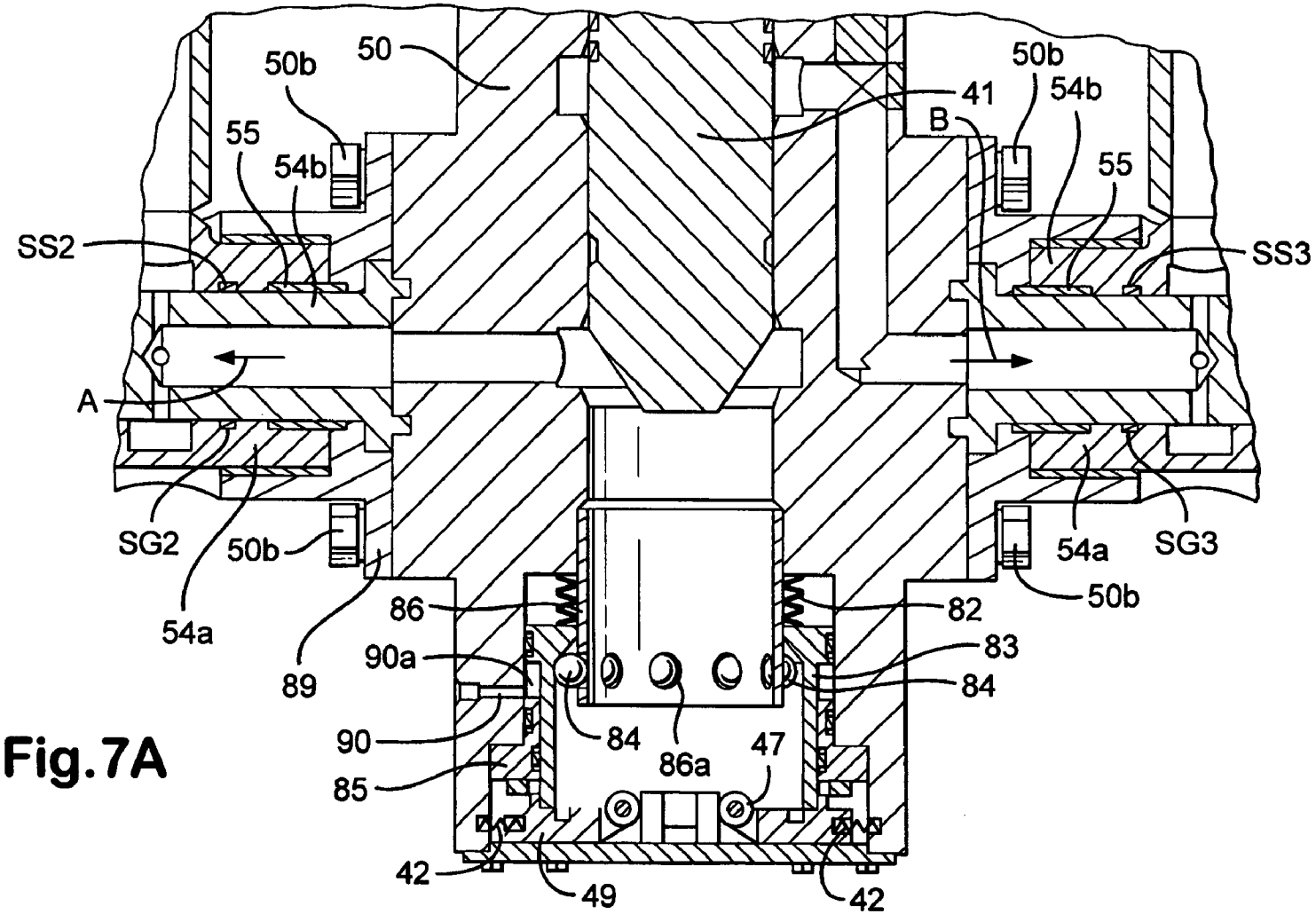
FIGS. 7A and 7B are enlargements of part of the system as shown in FIG. 6.
Figure 7B:
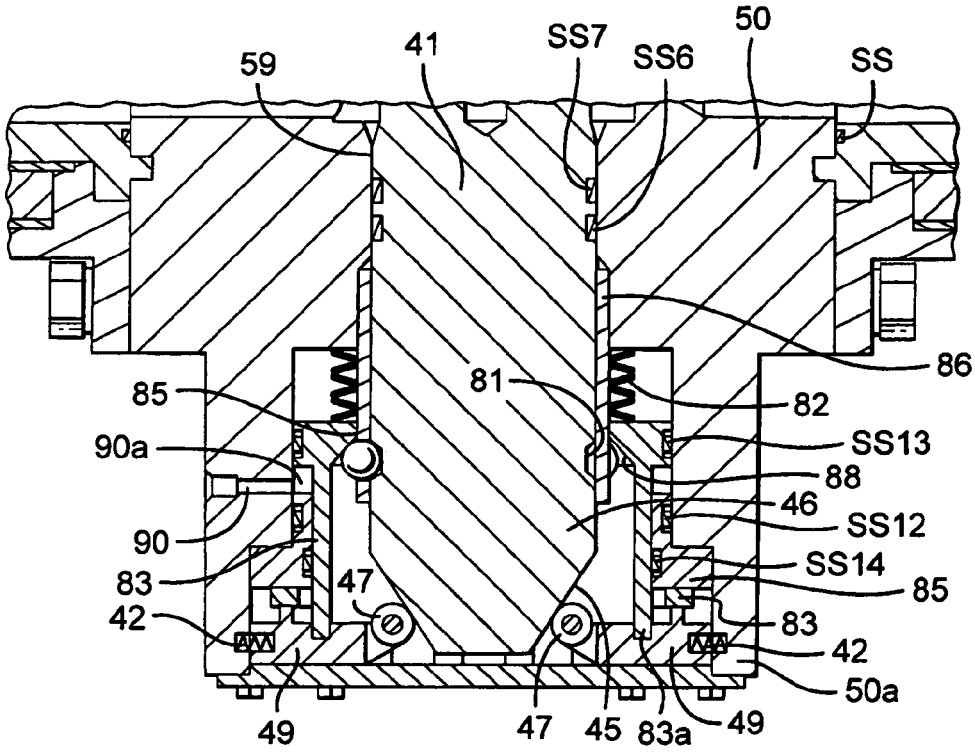
Figure 7C:
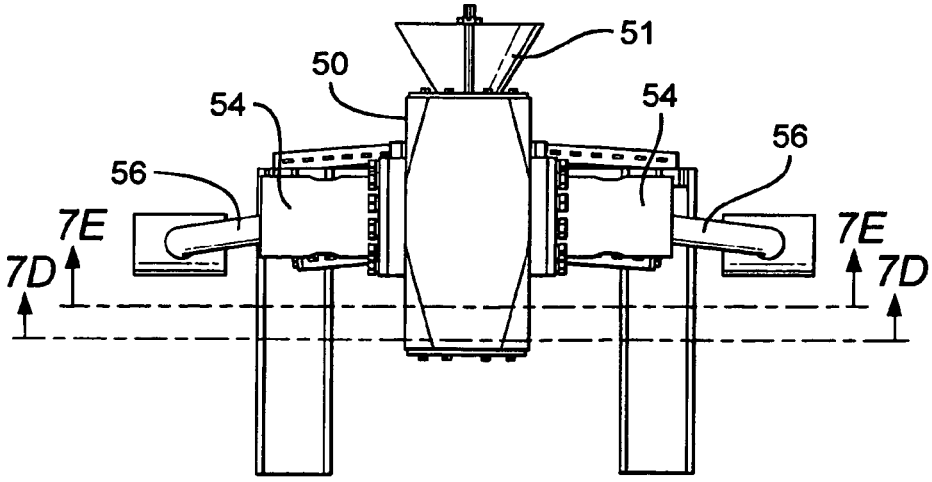
FIG. 7C is a top view of the system of FIG. 6.
Figure 7D:
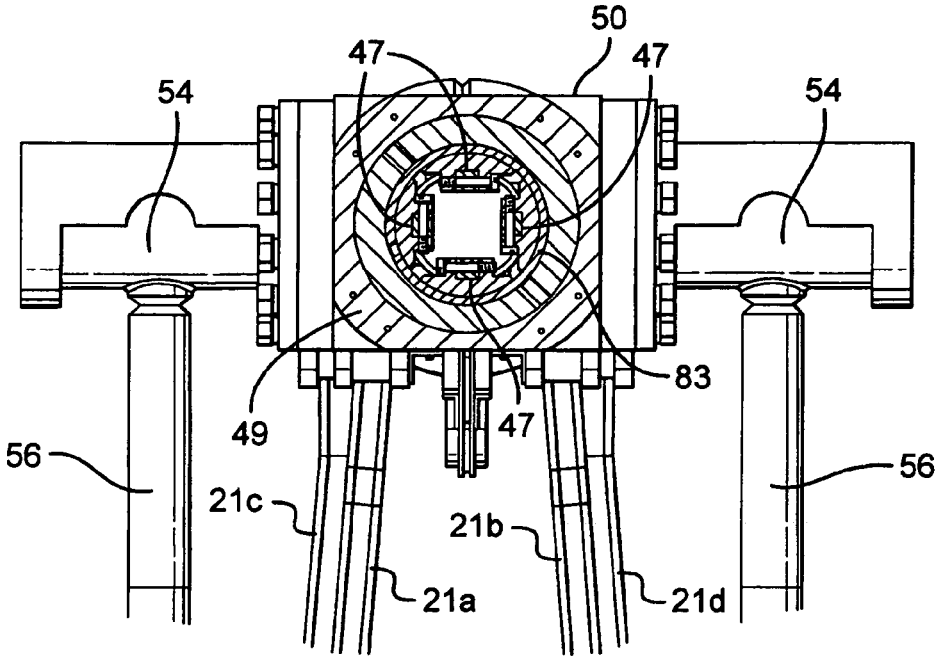
FIG. 7D is a cross-section view along lines 7D-7D of FIG. 7C.
Figure 7E:
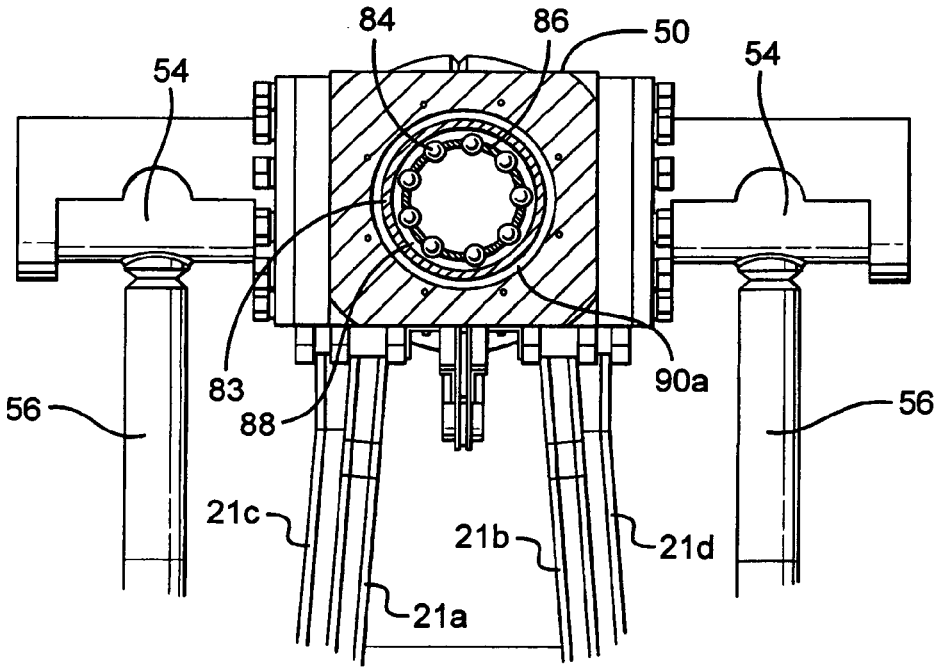
FIG. 7E is a cross-section view along lines 7E-7E of FIG. 7C.
Figure 8A:
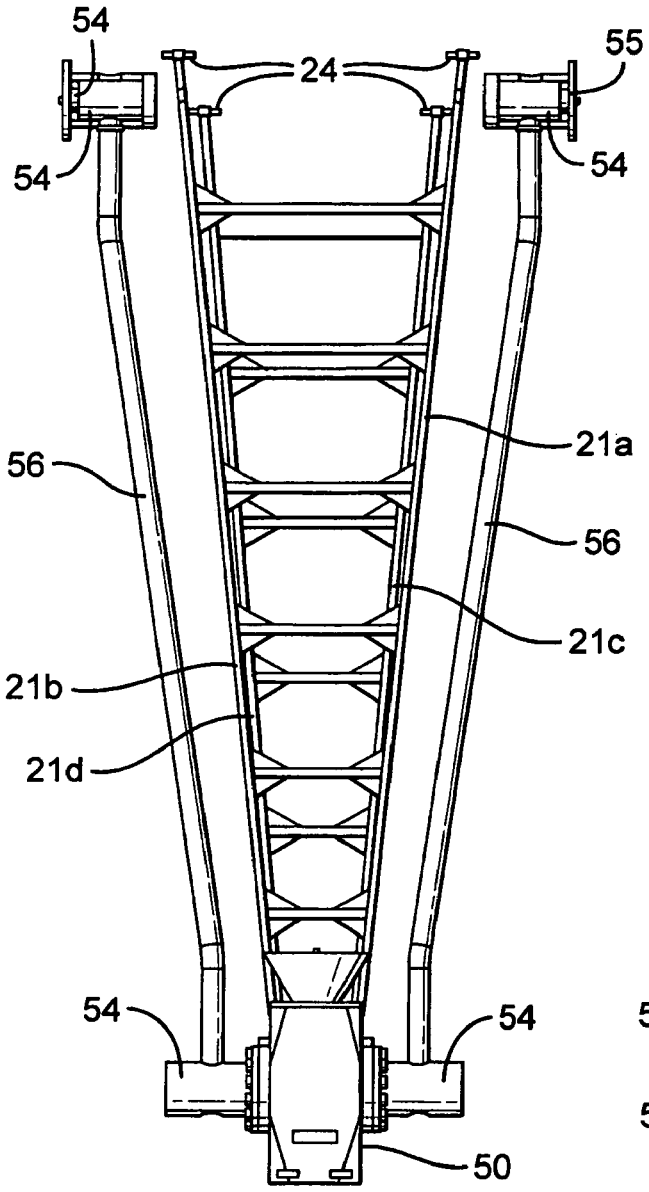
FIG. 8A is a front view of part of the system of FIG. 1.
Figure 8B:
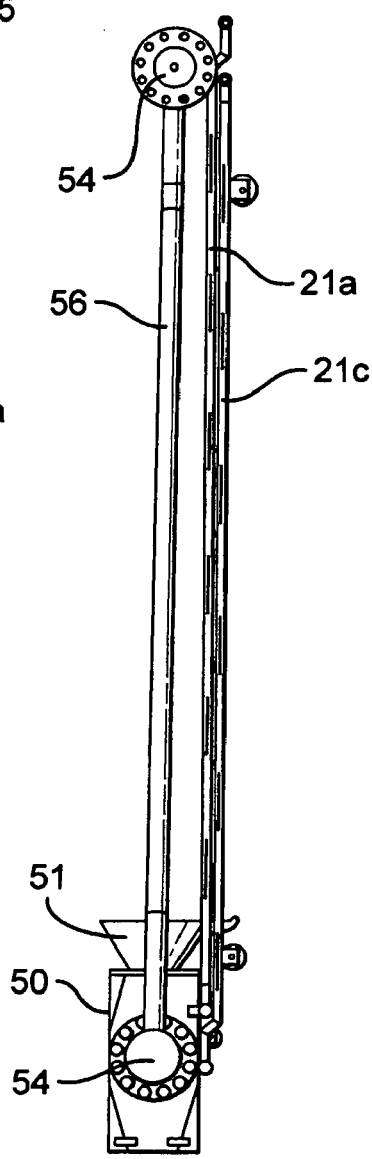
FIG. 8B is a side view of the parts shown in FIG. 8A.
Figure 8C:
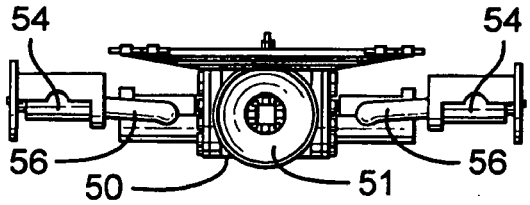
FIG. 8C is a top view of the parts shown in FIG. 8A.

The fluid stab latching system, in certain aspects, as shown in FIGS. 7A-7E is mechanically triggered when the stab 41 is pulled into latching position by the landing winch 18 which pulls the stab 41 into the funnel part 51 and into a bore 59 of the connector 50. Triggering the latch sequence is achieved when a chamfer 45 on a nose 46 of the stab 41' contacts rollers 47 on an edge 48 of a series of triggering slides 49 (four used in the system of FIG. 7A). When the slides 49 (which are biased inwardly by springs 42) are translated a small distance by the urging of the advancing stab, a latching sleeve 83 movably mounted within the connector 50 is allowed to shift to relieve some of the force applied by a spring 82 with an end 83*a* of the latching sleeve 83 received in a notch 47 of the slides 49 (FIG. 7B). The latching sleeve 83 in turn causes a series of retaining balls 84 to move radially in holes 86*a* bored into a retaining sleeve 86. The retaining balls 84 stop moving radially when they come in contact with the minor diameter of a latching land 81 on the intervention fluid stab 40. The force applied to the balls 84 by the spring 82 via the ramp 88 holds the balls 84 in place. The remaining force supplied by the spring 82 acting on the latching sleeve 83 prevents the intervention fluid stab 40 from separating from the connector 50. Pulling up on the stab 41 moves the latching sleeve 83, and the balls 84 contact the ramp 88. The balls 84 move out of the land 81, releasing the stab 41.

When the stab 41 is releasably latched to the connector 50, the stab 41 supports the weight of the connector 50—which weight is the only load on the latching mechanism of the connector 50 (other weight being supported by the frame F).

An emergency disconnect condition occurs when the separation force acting on the fluid stab assembly 60 exceeds the force of the spring 82 and the retaining balls 84 are urged radially outward through the retaining sleeve 86 as the balls 84 ride up on tapers 87 on the stab 41 and a ramp 88 on latching sleeve 83. An emergency disconnect condition occurs when the separation force acting on the fluid stab assembly 60 exceeds the force of the spring 82 and the retaining balls 84 are urged radially outward through the retaining sleeve 86 as the balls 84 ride up on tapers 87. When a sufficient upward vertical force is applied to the fluid stab, the spring force is overcome resulting in the latching sleeve moving vertically upward, which in turn allows the balls to move radially outward until they clear the OD of the fluid stab.

A normal disconnect sequence occurs when an hydraulic control fluid pressure is applied to an annular actuator piston circuit 90 on the latching sleeve 83 and fluid flows into a space 90*a*. The presence of the fluid pressure causes the latching sleeve 83 to shift upward against the urging of the spring 82 allowing the retaining balls 84 to shift radially outward in the holes 86*a* in the retaining sleeve 86 allowing the connector 50 to fall away from the stab 41. The connector 50 falls to its stowed position inside the intervention module frame 30.

During operation, stresses induced on the bottom of the PDL 12 by wave action are, in certain aspects, mitigated by utilizing a tapered stress joint 17.

After the fluid stab assembly 60 is connected to the intervention fluid transfer manifold 52, fluid can be transferred from equipment on the deployment vessel 14 via the PDL 12 to the intervention module 30. The latching system can then be deactivated either by hydraulic signal from the intervention module 30 (using the hydraulic circuit 90) or by forcibly separating the stab 41 from the connector 52 using the PDL deployment injector 13 on the vessel 14 to pull the stab 41 out of the connector 50 (e.g. by pulling on the assembly 60 with force greater than force of the spring 82; e.g., in one aspect, with a force of 10,000 pounds). In either case, the heave compensation device 20 returns to its stowed position under the influence of gravity.

Bolts 50*b* bolt a seal housing 89 to a body 50*a* of the connector 50. Seals SS (SS1-SS14) seal the interfaces indicated. A seal member 85 holds the seals SS12 and SS14.

The present invention, therefore, provides in some, but not in necessarily all, embodiments a system for subsea transfer of intervention fluids to a subsea intervention apparatus, the system including: a structure for a subsea intervention apparatus; a frame pivotably mounted to the structure, the frame having a first end at the structure and a second end spaced-apart from the first end; a plurality of frame fluid conduits (e.g. two, three, four, or more) on the frame extending from the first end to the second end for conducting fluid from a connector to conduit apparatus in fluid communication with the subsea intervention apparatus; a connector at the second end of the frame for releasably holding an end of a fluid stab assembly; the connector having a plurality of connector fluid conduits therethrough, each connector fluid conduit corresponding to one of the plurality of frame fluid conduits, each connector fluid conduits in fluid communication with a corresponding frame fluid conduit; and the connector fluid conduits located for receiving fluid from a fluid stab assembly releasably held by the connector. Such an apparatus may have one or some, in any possible combination, of the following: receipt apparatus within the connector for receiving and releasably holding an end of a fluid stab assembly; a plurality of movable balls, and ball movement apparatus for selectively moving the plurality of movable balls so that a portion of each ball is movable into a corresponding recess in a fluid stab assembly for releasably securing the fluid stab assembly to the connector; wherein the ball movement apparatus includes a latching sleeve within the connector and an opening for receiving the end of the fluid stab assembly, the latching sleeve having a lower end and a sleeve part positioned for contacting the plurality of movable balls for moving the movable balls toward and away from the fluid stab assembly, slider apparatus within the connector and in contact with the latching sleeve, the slider apparatus having a groove, the slider apparatus positioned for contact by an end of the fluid stab assembly, said contact effecting outward movement of the slider apparatus permitting the lower end of the latching sleeve to move into the slider groove, said movement of the latching sleeve effecting movement of a portion of each ball of the plurality of movable balls into the corresponding recess of the fluid stab assembly to releasably connect the fluid stab assembly to the connector, and spring apparatus within the connector urging the latching sleeve downwardly toward the slider apparatus and, upon said outward movement of the slider apparatus, urging the lower end of the latching sleeve into the slider groove; a winch system with a winch line passing through the frame for releasable connection to a fluid stab assembly; and winching apparatus in the winch system for retrieving the winch line to pull the fluid stab assembly to the connector; dual spaced-apart support beams, each beam having a first end and a second end, each beam first end pivotably connected to the structure for the subsea intervention apparatus, each beam second end pivotably connected to the connector so that the connector moves vertically upon vertical movement of the beam second ends; wherein each frame fluid conduit is rotatably connected with a connector fluid swivel to the connector, each connector fluid swivel having a connector fluid channel therethrough in fluid communication with a corresponding connector fluid conduit; wherein each connector fluid swivel is a pressure balanced fluid swivel; wherein each frame fluid conduit is rotatably connected with a frame fluid swivel to the frame, each frame fluid swivel having a frame swivel channel in fluid communication with a corresponding frame fluid conduit; and fluid flowing from a frame fluid conduit to a frame swivel channel flowable to the subsea intervention apparatus; wherein each frame fluid swivel is a pressure balanced fluid swivel; wherein each connector fluid swivel has a water lubricated bearing for facilitating rotation of the frame fluid conduit about the connector fluid swivel; wherein each frame fluid swivel has a water lubricated bearing for facilitating rotation of the frame fluid conduit about the connector fluid swivel; wherein each frame fluid conduit has two sides and each connector fluid swivel has a fluid gland and a fluid seal on each side of the frame fluid conduit so that fluid induced loads are cancelled; wherein each frame fluid swivel has two sides and each connector fluid swivel has a fluid gland and a fluid seal on each side of the frame fluid conduit so that fluid induced loads are cancelled; a fluid stab assembly for releasable connection to the connector, the fluid stab assembly in fluid communication with a pump down line and having a plurality of stab channels for conducting a plurality of intervention fluids from the pump down line to the connector for transfer to the subsea intervention apparatus; wherein the fluid stab assembly includes weight apparatus to facilitate connection of the fluid stab assembly to the connector; wherein the connector has funnel apparatus for facilitating entry of a lower end of the fluid stab assembly into the connector; wherein the fluid stab assembly has connection structure for releasable securement thereto of a winch line; sheave apparatus on the connector for guiding the winch line, the sheave apparatus located so that with the winch line attached to the fluid stab assembly vertical displacements of the fluid stab assembly do not alter a relative position of the fluid stab assembly with respect to the connector; a recess in the fluid stab assembly for receiving movable balls, a plurality of movable balls, and ball movement apparatus for selectively moving the plurality of movable balls so that a portion of each ball is movable into a corresponding recess in the fluid stab assembly for releasably securing the fluid stab assembly to the connector; wherein the frame fluid conduits are rigid; active disconnecting apparatus for imposing hydraulic fluid under pressure on the connector to release a fluid stab assembly from the connector; and/or releasable holding apparatus for maintaining the connector latched to a fluid stab assembly, and the releasable holding apparatus releasable by pulling up on a fluid stab assembly held by the connector.

The present invention, therefore, provides in some, but not in necessarily all, embodiments a system for subsea transfer of intervention fluids to a subsea intervention apparatus, the system including a structure for a subsea intervention apparatus; a frame pivotably mounted to the structure, the frame having a first end at the structure and a second end spaced-apart from the first end; a plurality of frame fluid conduits on the frame extending from the first end to the second end for conducting fluid from a connector to conduit apparatus in fluid communication with the subsea intervention apparatus; a connector at the second end of the frame for releasably holding an end of a fluid stab assembly; the connector having a plurality of connector fluid conduits therethrough corresponding to the plurality of frame fluid conduits, each connector fluid conduits in fluid communication with a corresponding frame fluid conduit; the connector fluid conduits located for receiving fluid from a fluid stab assembly releasably held by the connector; and wherein each frame fluid conduit is rigid.

The present invention, therefore, provides in some, but not in necessarily all, embodiments a method for transferring intervention fluids from a pump down line to a subsea intervention apparatus, the method including flowing fluid through a pump down line into a fluid stab assembly connected to a connector of a system for subsea transfer of fluids, the system as any disclosed herein according to the present invention, flowing the fluid through the connector, flowing the fluid through the plurality of frame conduits, and flowing the fluid from the plurality of frame conduits to the subsea intervention apparatus.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes.

What is claimed is:

1. A system for subsea transfer of intervention fluids to a subsea intervention apparatus, the system comprising a structure for a subsea intervention apparatus, a frame pivotably mounted to the structure, the frame having a first end at the structure and a second end spaced-apart from the first end, a plurality of frame fluid conduits on the frame extending from the first end to the second end for conducting fluid from a connector to conduit apparatus in fluid communication with the subsea intervention apparatus, a connector at the second end of the frame for releasably holding an end of a fluid stab assembly, the connector having a plurality of connector fluid conduits therethrough corresponding to the plurality of frame fluid conduits, each connector fluid conduits in fluid communication with a corresponding frame fluid conduit, the connector fluid conduits located for receiving fluid from a fluid stab assembly releasably held by the connector, receipt apparatus within the connector for receiving and releasably holding an end of a fluid stab assembly, a plurality of movable balls, ball movement apparatus for selectively moving the plurality of movable balls so that a portion of each ball is movable into a corresponding recess in a fluid stab assembly for releasably securing the fluid stab assembly to the connector, wherein the ball movement apparatus includes a latching sleeve within the connector and an opening for receiving the end of the fluid stab assembly, the latching sleeve having a lower end and a sleeve part positioned for contacting the plurality of movable balls for moving the movable balls toward and away from the fluid stab assembly, slider apparatus within the connector and in contact with the latching sleeve, the slider apparatus having a groove, the slider apparatus positioned for contact by an end of the fluid stab assembly, said contact effecting outward movement of the slider apparatus permitting the lower end of the latching sleeve to move into the slider groove, said movement of the latching sleeve effecting movement of a portion of each ball of the plurality of movable balls into the corresponding recess of the fluid stab assembly to releasably connect the fluid stab assembly to the connector, and spring apparatus within the connector urging the latching sleeve downwardly toward the slider apparatus and, upon said outward movement of the slider apparatus, urging the lower end of the latching sleeve into the slider groove.

2. A system for subsea transfer of intervention fluids to a subsea intervention apparatus, the system comprising a structure for a subsea intervention apparatus, a frame pivotably mounted to the structure, the frame having a first end at the structure and a second end spaced-apart from the first end, a plurality of frame fluid conduits on the frame extending from the first end to the second end for conducting fluid from a connector to conduit apparatus in fluid communication with the subsea intervention apparatus, a connector at the second end of the frame for releasably holding an end of a fluid stab assembly, the connector having a plurality of connector fluid conduits therethrough corresponding to the plurality of frame fluid conduits, each connector fluid conduit in fluid communication with a corresponding frame fluid conduit, the connector fluid conduits located for receiving fluid from a fluid stab assembly releasably held by the connector, each frame fluid conduit rotatably connected with a frame fluid swivel to the frame, each frame fluid swivel having a frame swivel channel in fluid communication with a corresponding frame fluid conduit, each frame fluid conduit rotatably connected with a connector fluid swivel to the connector, and fluid flowing from a frame fluid conduit to a frame swivel channel flowable to the subsea intervention apparatus.

3. The system of claim 2 wherein each frame fluid swivel is a pressure balanced fluid swivel.

4. The system of claim 2 wherein each connector fluid swivel has a water lubricated bearing for facilitating rotation of the frame fluid conduit about the connector fluid swivel.

5. The system of claim 3 wherein each frame fluid swivel has a water lubricated bearing for facilitating rotation of the frame fluid conduit about the connector fluid swivel.

6. The system of claim 2 wherein each frame fluid conduit has two sides and each connector fluid swivel has a fluid gland and a fluid seal on each side of the frame fluid conduit so that fluid induced loads are cancelled.

7. The system of claim 3 wherein each frame fluid swivel has two sides and each connector fluid swivel has a fluid gland and a fluid seal on each side of the frame fluid conduit so that fluid induced loads are cancelled.

8. A system for subsea transfer of intervention fluids to a subsea intervention apparatus, the system comprising a structure for a subsea intervention apparatus, a frame pivotably mounted to the structure, the frame having a first end at the structure and a second end spaced-apart from the first end, a plurality of rigid frame fluid conduits on the frame extending from the first end to the second end for conducting fluid from a connector to conduit apparatus in fluid communication with the subsea intervention apparatus, a connector at the second end of the frame for releasably holding an end of a fluid stab assembly, the connector having a plurality of connector fluid conduits therethrough corresponding to the plurality of frame fluid conduits, each connector fluid conduit in fluid communication with a corresponding frame fluid conduit, the connector fluid conduits located for receiving fluid from a fluid stab assembly releasably held by the connector, receipt apparatus within the connector for receiving and releasably holding an end of a fluid stab assembly, wherein the receipt apparatus includes a plurality of movable balls, and ball movement apparatus for selectively moving the plurality of movable balls so that a portion of each ball is movable into a corresponding recess in a fluid stab assembly for releasably securing the fluid stab assembly to the connector, wherein the ball movement apparatus includes a latching sleeve within the connector and an opening for receiving the end of the fluid stab assembly, the latching sleeve having a lower end and a sleeve part positioned for contacting the plurality of movable balls for moving the movable balls toward and away from the fluid stab assembly, slider apparatus within the connector and in contact with the latching sleeve, the slider apparatus having a groove, the slider apparatus positioned for contact by an end of the fluid stab assembly, said contact effecting outward movement of the slider apparatus permitting the lower end of the latching sleeve to move into the slider groove, said movement of the latching sleeve effecting movement of a portion of each ball of the plurality of movable balls into the corresponding recess of the fluid stab assembly to releasably connect the fluid stab assembly to the connector, and spring apparatus within the connector urging the latching sleeve downwardly toward the slider apparatus and, upon said outward movement of the slider apparatus, urging the lower end of the latching sleeve into the slider groove.

9. A system for subsea transfer of intervention fluids to a subsea intervention apparatus, the system comprising a module comprising a stationary subsea intervention module on a subsea well, a frame pivotably mounted to the module, the frame having a first end at the module and a second end spaced-apart from the first end, a plurality of rigid frame fluid conduits on the frame extending from the first end to the second end for conducting fluid from a connector to conduit apparatus in fluid communication with the module, a connector at the second end of the frame for releasably holding an end of a fluid stab assembly, the connector having a plurality of connector fluid conduits therethrough corresponding to the plurality of frame fluid conduits, each connector fluid conduit in fluid communication with a corresponding frame fluid conduit, the connector fluid conduits located for receiving fluid from a fluid stab assembly releasably held by the connector, receipt apparatus within the connector for receiving and releasably holding an end of a fluid stab assembly, a plurality of movable balls, ball movement apparatus for selectively moving the plurality of movable balls so that a portion of each ball is movable into a corresponding recess in a fluid stab assembly for releasably securing the fluid stab assembly to the connector, the ball movement apparatus including a latching sleeve within the connector and an opening for receiving the end of the fluid stab assembly, the latching sleeve having a lower end and a sleeve part positioned for contacting the plurality of movable balls for moving the movable balls toward and away from the fluid stab assembly, slider apparatus within the connector and in contact with the latching sleeve, the slider apparatus having a groove, the slider apparatus positioned for contact by an end of the fluid stab assembly, said contact effecting outward movement of the slider apparatus permitting the lower end of the latching sleeve to move into the slider groove, said movement of the latching sleeve effecting movement of a portion of each ball of the plurality of movable balls into the corresponding recess of the fluid stab assembly to releasably connect the fluid stab assembly to the connector, and spring apparatus within the connector urging the latching sleeve downwardly toward the slider apparatus and, upon said outward movement of the slider apparatus, urging the lower end of the latching sleeve into the slider groove.

10. The system of claim 9 further comprising a winch system with a winch line passing through the frame for releasable connection to a fluid stab assembly, and winching apparatus in the winch system for retrieving the winch line to pull the fluid stab assembly to the connector.

11. The system of claim 9 wherein the frame includes dual spaced-apart support beams, each beam having a first end and a second end, each beam first end pivotably connected to the structure for the subsea intervention apparatus, and each beam second end pivotably connected to the connector so that the connector moves vertically upon vertical movement of the beam second ends.

12. The system of claim 9 wherein each frame fluid conduit is rotatably connected with a connector fluid swivel to the connector, each connector fluid swivel having a connector fluid channel therethrough in fluid communication with a corresponding connector fluid conduit.

13. The system of claim 12 wherein each connector fluid swivel is a pressure balanced fluid swivel.

14. The system of claim 9 wherein each frame fluid conduit is rotatably connected with a frame fluid swivel to the frame, each frame fluid swivel having a frame swivel channel in fluid communication with a corresponding frame fluid conduit, and fluid flowing from a frame fluid conduit to a frame swivel channel flowable to the subsea intervention apparatus.

15. The system of claim 14 wherein each frame fluid swivel is a pressure balanced fluid swivel.

16. The system of claim 13 wherein each connector fluid swivel has a water lubricated bearing for facilitating rotation of the frame fluid conduit about the connector fluid swivel.

17. The system of claim 15 wherein each frame fluid swivel has a water lubricated bearing for facilitating rotation of the frame fluid conduit about the frame fluid swivel.

18. The system of claim 13 wherein each frame fluid conduit has two sides and each connector fluid swivel has a fluid gland and a fluid seal on each side of the frame fluid conduit so that fluid induced loads are cancelled.

19. The system of claim 15 wherein each frame fluid conduit has two sides and each frame fluid swivel has a fluid gland and a fluid seal on each side of the frame fluid conduit so that fluid induced loads are cancelled.

20. The system of claim 9 further comprising the fluid stab assembly in fluid communication with a pump down line and having a plurality of stab channels for conducting a plurality of intervention fluids from the pump down line to the connector for transfer to the subsea intervention apparatus.

21. The system of claim 20 wherein the fluid stab assembly includes weight apparatus to facilitate connection of the fluid stab assembly to the connector.

22. The system of claim 20 wherein the connector has funnel apparatus for facilitating entry of a lower end of the fluid stab assembly into the connector.

23. The system of claim 20 wherein the fluid stab assembly has connection structure for releasable securement thereto of a winch line.

24. The system of claim 23 further comprising sheave apparatus on the connector for guiding the winch line, the sheave apparatus located so that with the winch line attached to the fluid stab assembly vertical displacements of the fluid stab assembly do not alter a relative position of the fluid stab assembly with respect to the connector.

25. The system of claim 9 further comprising active disconnecting apparatus for imposing hydraulic fluid under pressure on the connector to release a fluid stab assembly from the connector.

26. The system of claim 9 further comprising the receipt apparatus releasable by pulling up on a fluid stab assembly held by the connector.

* * * * *